United States Patent [19]

Taylor et al.

[11] 4,003,524

[45] Jan. 18, 1977

[54] CROSS-WINDING MACHINE

[76] Inventors: James Dove Wilford Taylor, Gorebrook Works, Pink Bank Lane, Longsight, Manchester; Stephen Temple, Bar Hill, Cambridge, both of England

[22] Filed: Nov. 29, 1974

[21] Appl. No.: 528,100

[30] Foreign Application Priority Data

Dec. 4, 1973 United Kingdom ..... 56190/73

[52] U.S. Cl. ..... 242/18 R; 28/21; 242/35.5 R; 242/41; 242/53

[51] Int. Cl.[2] ..... B65H 54/02; B65H 54/06

[58] Field of Search ..... 242/18 R, 18 DD, 35.5 R, 242/35.5 A, 41, 53; 28/21

[56] References Cited

UNITED STATES PATENTS

| | | | |
|---|---|---|---|
| 1,267,913 | 5/1918 | Seifert | 242/41 |
| 3,426,408 | 2/1969 | Wheelock | 242/18 R X |
| 3,693,897 | 9/1972 | Davidson | 242/18 R |

*Primary Examiner*—Stanley N. Gilreath
*Attorney, Agent, or Firm*—Burgess Ryan and Wayne

[57] ABSTRACT

A cross-winding machine comprises a winding mandrel and means for rotating the mandrel so that yarn supplied thereto is formed on the mandrel into a cross-wound package. Reciprocably movable doffing means transfer a wound package on the mandrel to a position which permits winding of a further package. A package support extends in alignment with the end of the mandrel and receives and supports packages successively doffed by the doffing means, thread severing means being provided which operate to cut thread between the mandrel and the package support.

25 Claims, 10 Drawing Figures

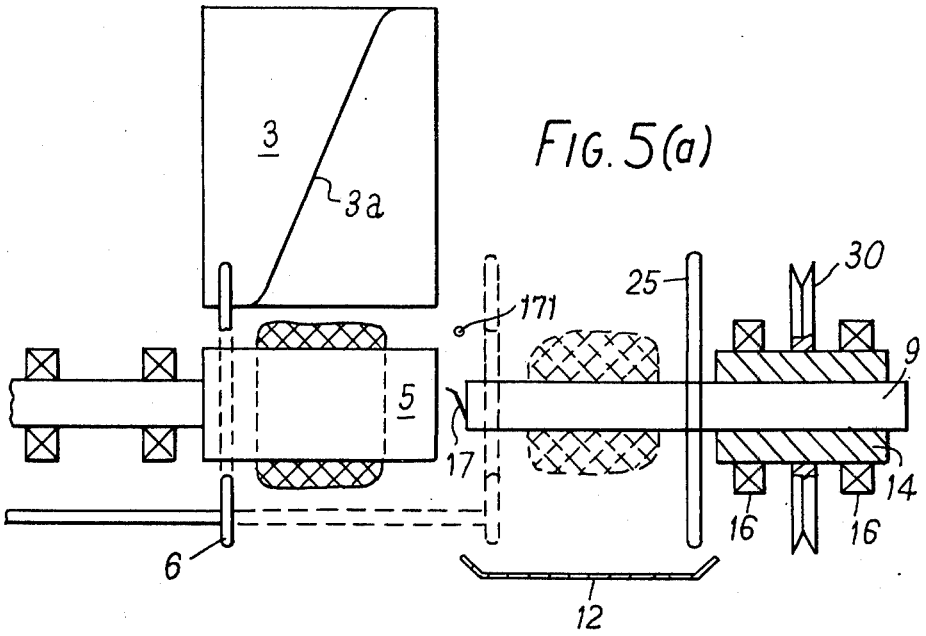
FIG. 5(a)
FIG. 5(b)
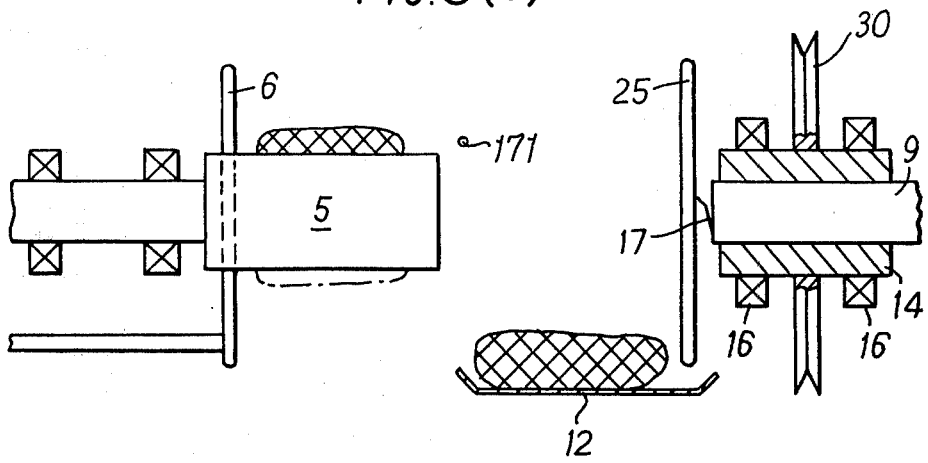

CROSS-WINDING MACHINE

This invention relates to cross-winding machines and has for its object the provision of such a machine which enables either or both doffing of cross-wound packages, e.g., pull-skeins to take place in a positive manner without interruption of the winding process so that high productivity of wound packages is achievable.

The present invention consists in a cross-winding machine, comprising a winding mandrel, means for continuously rotating the mandrel whilst cross-wound packages are successively formed thereon, a package support extending in alignment with the mandrel to receive wound packages therefrom, package doffing means having a package doffing member and reciprocable means for moving said member, upon completion of winding on the mandrel of a first wound package, alongside the mandrel first from a retracted position remote from the package support to a position in which rotation of said first wound package at mandrel speed is maintained until a predetermined part of the winding of a second package has been effected on the mandrel and then to a position in which said first wound package is transferred to the package support, and, thread severing means operable to cut thread between the mandrel and the package support.

Figure 1:
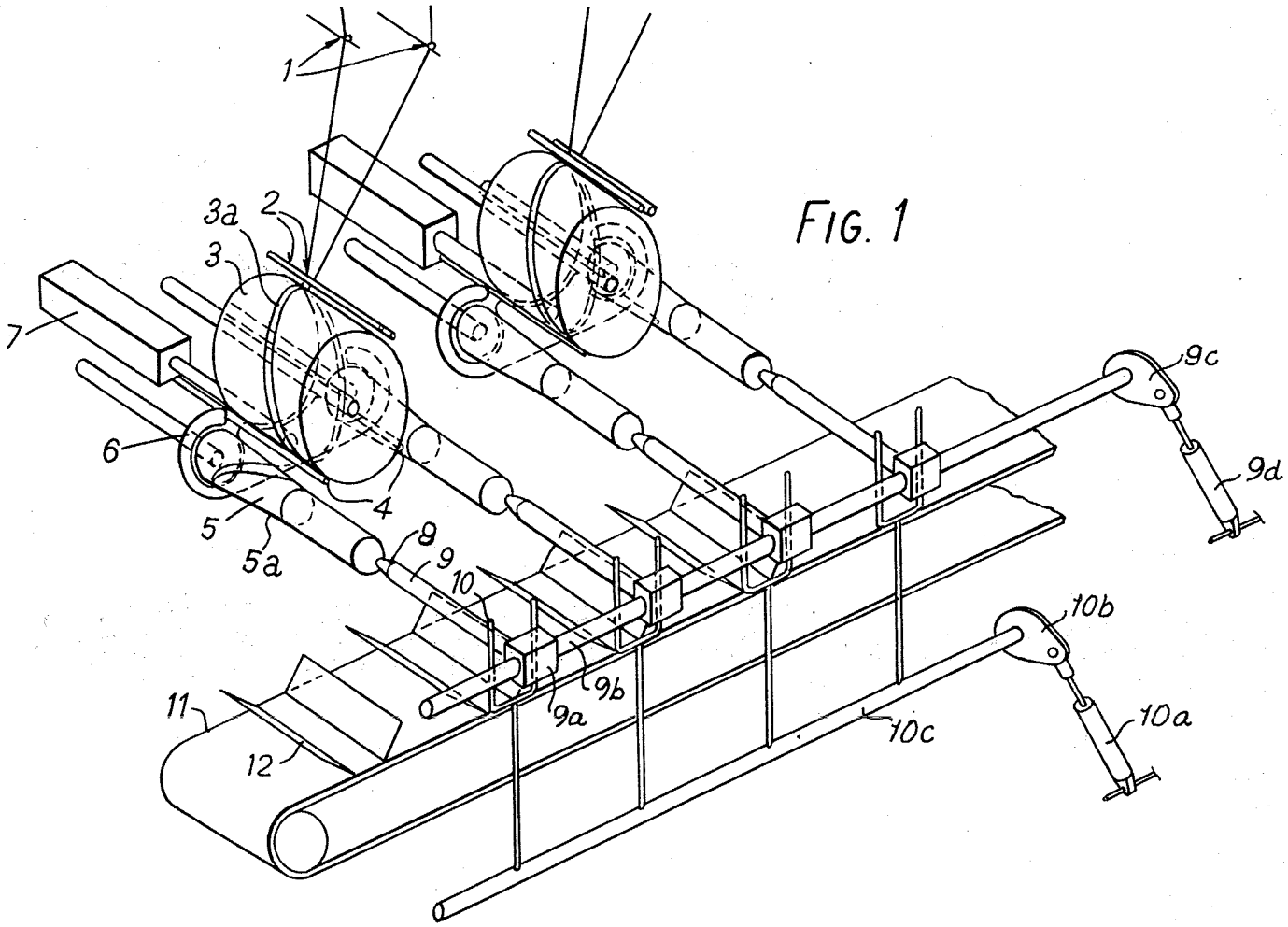
Figure 2:
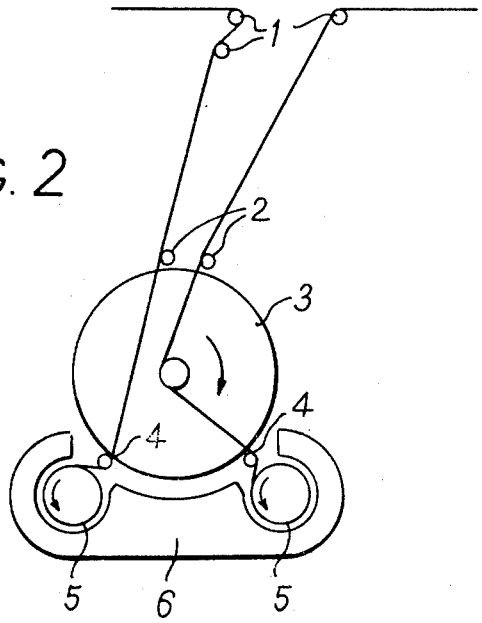
Figure 4A:
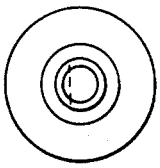
Figure 4B:
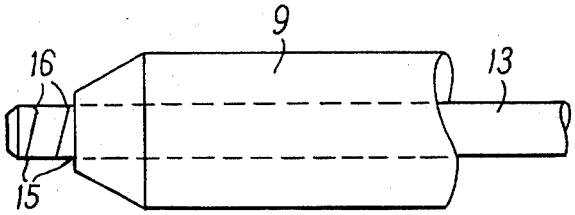
Figure 4C:
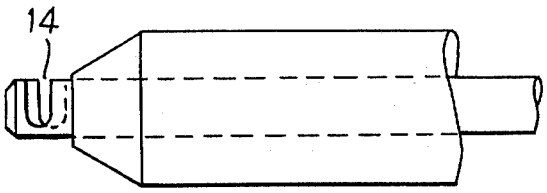
Figure 3:
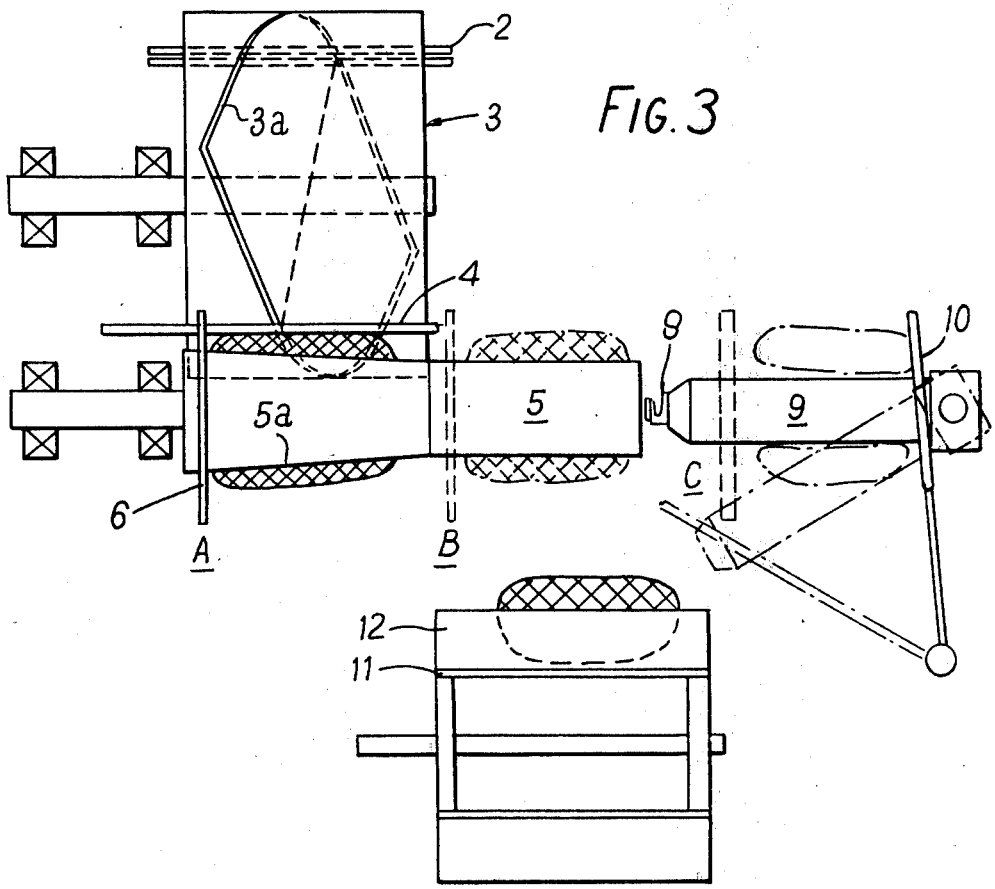
Figure 6A:
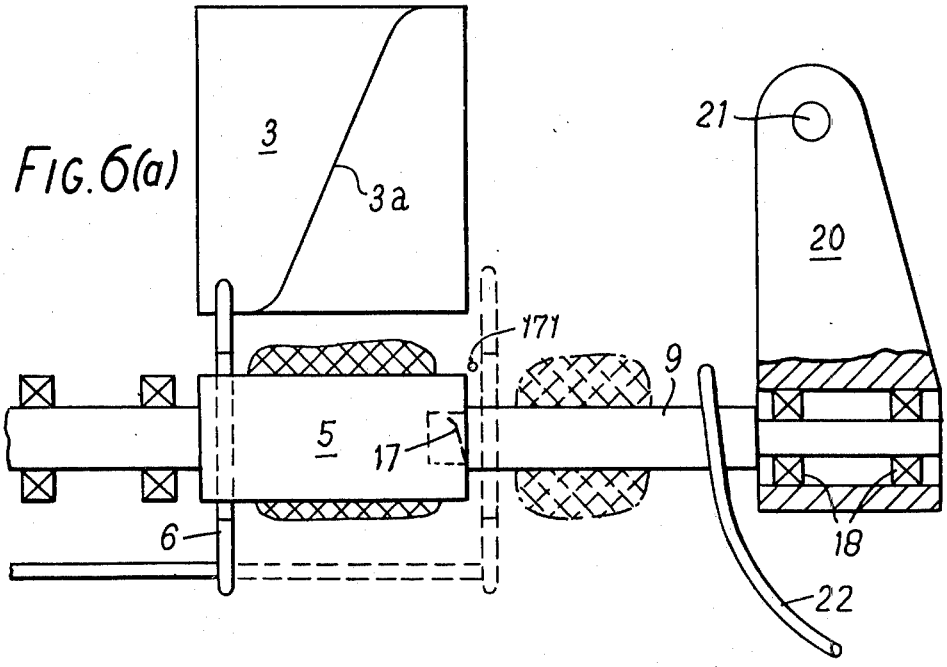
Figure 6B:
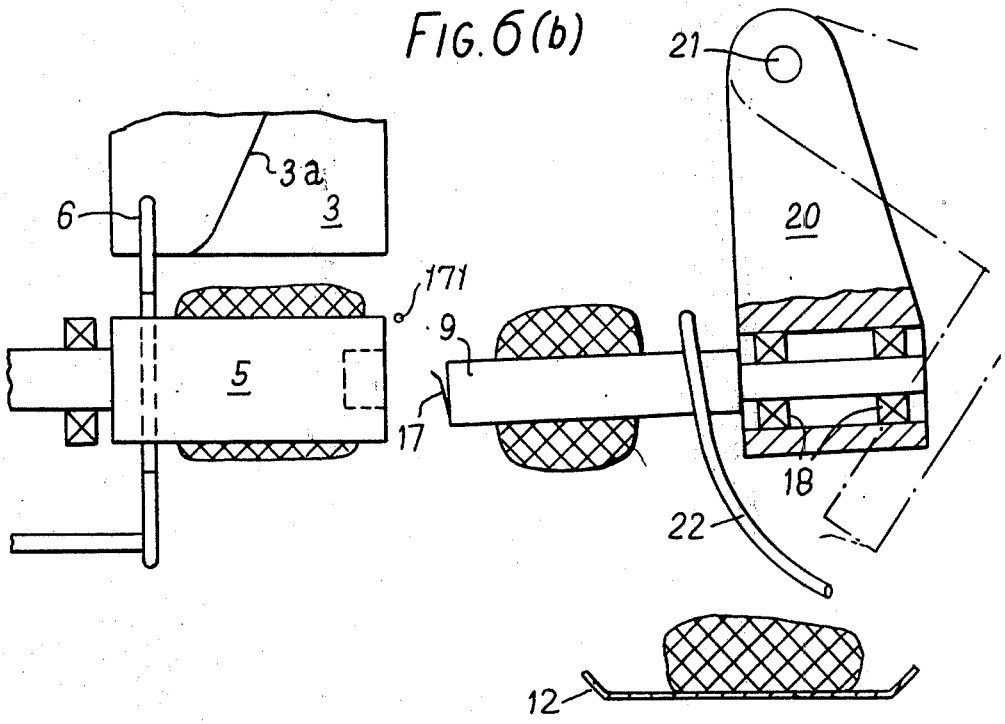

The invention will now be described, by way of example, with reference to the accompanying drawings, in which:

FIG. 1 shows a perspective view of part of a multi-spindle cross-winding machine according to the invention suitable for the production of cross-wound skeins FIG. 2 shows a front view of one pair of mandrels of the machine of FIG. 1 with the common split (traverse) guide drum FIG. 3 shows side view of one station of the machine FIGS. 4 (*a*) to (*c*) show to an enlarged scale a detail of the machine of the earlier figures FIGS. 5 (*a*) and (*b*) are views similar to FIG. 2 of different operating positions of a modified form of the machine of FIGS. 1 to 3, and FIGS. 6 (*a*) and (*b*) are views similar to those of FIGS. 5 (*a*) and (*b*) of a further modified form of the machine of FIGS. 1 to 3.

In the drawings like parts are accorded the same references.

Referring first to FIGS. 1 to 4 (*a*) to (*c*) the winding arrangement is like a normal cross-winding machine. There is a split guide drum 3 of known form with a helical slot 3*a* to traverse the yarn as it is wound on to the mandrel 5, the helical slot 3*a* has two segments each spanning 180° and of respective right and left hand threads. The yarn enters the machine through threadguide bars 1, passes down between guide rods 2, through the traverse drum 3 round the guide rods 4 on to the mandrel 5. The mandrel 5 and traverse drum 3 are geared together in such a way that ratios around 1:1, 1:2, 1:3, etc., can be produced by change wheels. The ratio is not set exactly there being an additional coupling using taper pulleys and a flat belt to give a fine adjustment of the overall ratio between mandrel and drum. By careful adjustment a winding can be produced in which a set number of crossings is made and subsequent layers are laid side by side to give an even appearance. This is normal to all precision winding machines. The mandrel is interchangeable for different sized skeins, and may be tapered as at 5*a* to assist doffing. The spacing between the traverse drum and the mandrel can be altered to accommodate different sized skeins. This is achieved by mounting the traverse drum spindles on a common frame (not shown) that can be jacked up and down with screw jacks relative to the mandrels. The machine consists of several winding mandrels 5 and traverse drums 3, some only of which are shown.

A doffing plate 6 is provided for each pair of mandrels 5 associated with a drum 3 and is actuated by an air ram 7 to push the skeins along the mandrels and off the ends thereof each on to a stationary 'fid' or support 9 in the form of a rod having a knife 8 at its end adjacent mandrel 5. Each of the fids 9 is mounted remotely from the knife 8 in a hollow block 9*a* secured to a shaft 9*b* which is reciprocably rotatable by means of a crank 9*c* and air ram 9*d*. The rotation of shaft 9*b* causes the fids 9 to drop down so that an ejector 10, pivotally reciprocable by means of an air ram 10*a* connected by means of a crank 10*b* to a rotatable shaft 10*c* of the ejector, can push the skeins on the respective fids 9 together onto cups 12 on a conveyor 11. The conveyor which is driven by a separate electric motor by way of an air operated clutch and brake unit (not shown) takes the skeins to the end of the machine where they may be put in a bin or fed into some subsequent machine such as a labeller.

It will be observed that at each station of the machine two yarns are threaded through each traverse drum 3 and wound on to separate mandrels 5. In this manner a large diameter traverse drum can be used reducing the helix angle and consequently the friction. This in turn permits higher speeds of winding than are normally possible. FIG. 2 shows how the two threads are arranged, and also it will be seen that in order to have optimum thread separation at the point of entry of the drum the right hand thread passes round the drum shaft. Due to rotation the thread suffers additional tension which is equalized for the left hand thread by providing an additional guide bar 1.

In operation, as will be apparent particularly from FIG. 3 when the skein is complete without slowing or stopping the mandrel 5, the doffing plate 6 is moved by ram 7 from its normal position A to position B in the course of one traverse of the thread along the skein. The skein moves as indicated; and there is then a dwell of the plate 6 while a few turns of yarn are wound upon the cleared mandrel. The doffing plate 6 then moves on to position C taking the skein with it. The skein now stops rotating by frictional contact with the stationary fid 9. As it does so, the yarn still connecting it to the new winding twists around the end of the fid and round the knife 8. Once the yarn is engaged with the knife, the doffing plate is withdrawn by ram 7 to its normal position A. It withdraws over the few turns on the new skein without interfering with the yarn by virtue of the clearance between the plate and the mandrel (see FIG. 2) and the slot in the doffing plate provided for passage of the yarn from the guide rod 4 to the mandrel 5. As soon as the doffing plate has returned the knife 8 is actuated and cuts the new skein free. The end of the old skein, however, is trapped in the knife 8. At this stage winding of the new skein is free to continue normally, though it will be noted that the inner end of this skein is hanging out several inches so that the skein may eventually be unwound by pulling from the center.

The skein just doffed is now, resting on the fid 9 with the outer end of the yarn trapped in the knife. The fid is pivotted downwards to the position shown in broken lines (see FIG. 3) and then the ejector 10 swings forward pushing the skein down towards the corresponding cup 12 of the conveyor 11. As the ejector slides the skein off the end of the fid the free end of yarn is drawn inside the skein. The knife 8 is opened when the skein is part way off the fid thus releasing the end of yarn. Once the ejector has completed its movement, the skein is deposited in the cup 12 and the ejector and fid return to their normal positions.

The conveyor is stationary during this process, with one cup lying under each winding station. Thus at the end of the doffing sequence, each cup on the top of the conveyor contains one skein, and the conveyor is free to move on to deposit the skeins at one end of the machine.

FIGS. 4 (*a*) to (*c*) show details of the knife. The knife consists of a rod 13 slidable reciprocably in a hole bored axially through the fid 9 and by means of a small double acting air cylinder (not shown) contained in the block 9*a* (see FIG. 1). The end of the rod protrudes from the fid in the open position, and has a slot 14 cut across it at an angle. When the yarn wraps around the rod during doffing, it slips into the slot. The rod is then pulled back into the fid until the slot is completely inside the fid. The leading edge of the knife and the edge of the hole in the fid (points 16) are blunted: these engage the yarn first as the knife is withdrawn. Because they are blunt they do not cut the yarn but trap it, and press the opposite edges 15 of the knife and fid together. On continuing the movement the yarn in the slot is cut at the edges 15. The angle of the slot lies in such a direction that the yarn to become engaged on the blunt side comes from the doffed skein, whilst the yarn on the sharp side comes from the skein turning on the mandrel. Thus the new skein is cut free whilst the end of the doffed skein remains trapped until the knife is reopened.

The sequence of operations described above consists, it will be apparent, of doffing the skeins on the fids 9 by movement of the doffing plate first from position A to position B and then to position C, returning the doffing plate to position A, operating the knife 8, stopping the conveyor 11, pivoting the fids downwards, reciprocably pivoting the ejector 10 to transfer the skeins to the conveyor, operating knife 8 to release the skeins to enable transfer thereof to the conveyor, pivoting the fids upwards and restarting the conveyor. All these operations except for the stopping of the conveyor and the actuation of the knife 8 to release the skeins, which two operations are controlled by trips respectively on the conveyor 11 and ejector 10 which respectively control the conveyor clutch/brake mechanism and the ejector air ram 10*a*, are under the control of a sequencer of well-known form. One kind of such a sequencer is actuated either by a yarn metering device or by a counter on the drive of the mandrel 5. The sequencer actuates the air ram 7, the ram contained in block 9*a* and the rams 9*d* and 10*a* at appropriate points in the cycle of operations.

The sequencer is one form of several alternatives of extremely conventional and known arrangements which can be employed. Thus, for example, there can be used a gearbox driven by the mandrel and in turn operating a series of cams which actuate respective valves by way of which the air rams are supplied.

According to a desirable modification of the apparatus described above there is provided an electronically operated switch which is actuated in dependence upon the location of the guide drums 3 so as to initiate movement of the doffing plates 6 at a precise location of the thread on the wound skein.

In the modification illustrated in FIGS. 5 (*a*) and (*b*) the fid 9 instead of being stationary is rotatable synchronously with the mandrel 5 by means of a drive (not shown) engaging a pulley 30. The rotation of the fid enables doffing position B (see FIG. 3) to be dispensed with as will be seen from the description below of the operation. The fid 9 is spline connected for axial reciprocation thereof to a hub 14 to which pulley 30 is secured and which is rotatably mounted in bearings 16. At its end adjoining the mandrel 5, the fid 9 is provided with a hook 17 in the form of a bent metal strip required, as hereinafter described, if the end of the skein doffed on to the fid is to be tucked into the middle of the skein when the latter is doffed from the fid. FIGS. 5 (*a*) and (*b*) respectively illustrate projected and retracted positions of the fid, the former position, in which the fid is closely spaced from the mandrel, enabling a skein wound on the mandrel to be doffed by the plate 6 on to the fid whilst the movement of the fid from its projected to its retracted position enables doffing of a skein on the fid on to cup 12.

In operation, as the winding of a skein on the mandrel 5 is completed, the doffing plate 6 is actuated to move the skein to the position shown in broken lines on the fid 9. After sufficient time has elapsed to ensure that two or three layers of a new skein have been wound on the mandrel 5, the plate 6 is retracted over the newly winding skein and the fid which was rotating at the speed of the mandrel is slowed down thus causing the part of the thread between the skein on the fid and the winding skein on the mandrel to wrap round the hook 17. The yarn between the mandrel and the fid is then cut for example by a knife or hot wire 171 which passes between the hook 17 and the mandrel. When the fid has been slowed substantially to rest the fid is retracted thus drawing the end of the thread on the hook, because of the engagement between the skein and a fixed doffing member 25, into the middle of the skein and also disengaging the thread from the hook and the skein from the fid from which it drops into the cup 12. It will be apparent that, instead of the hook 17 and the knife or hot wire which passes between the hook 17 and the mandrel, the knife arrangement of FIGS. 4*a* to 4*c* can be employed.

Referring now to FIGS. 6 (*a*) and (*b*) it will be seen that the fid 9 is engaged with the mandrel to be driven thereby. Suitable clutch means (not shown) are provided for this purpose. The fid is rotatably supported in bearing 18 which are carried on an arm 20 pivotally mounted on pivot 21. The initial pivotal movement of the arm 20 about pivot 21 disengages the fid from the mandrel thus slowing down the fid and further pivotal movement causes doffing of the skein on the fid on to the cup 12 through engagement of the skein with doffing member 22.

In operation, on completion of winding of a skein on mandrel 5, the arm 20 is rotated and first disengages the fid from the mandrel so that the fid slows down. The relative rotation of the mandrel and fid causes the thread therebetween to wrap round the hook 17 whereupon cutting of the thread between the hook and the mandrel is effected by any suitable means such as a knife, hot wire 171 or scissors passing between the mandrel and the hook 17. The continued rotation of the arm 20 to the position shown in broken lines in FIG. 6 (*b*) effects stripping of the skein into the cup 12 the fid having slowed substantially to rest during this movement. Instead of the hook 17 and knife, hot wire or scissors described, the knife arrangement of FIGS. 4*a* to 4*c* can be employed. Equally, it will be appreciated that the arrangement of hook 17 and the knife, hot wire or scissors described in connection with FIGS. 6*a* and 6*b* may be employed in relation to the arrangement of FIGS. 1–3 instead of the knife arrangement illustrated in FIGS. 4*a* to 4*c*.

Whilst in the embodiments of the invention which have been described provision is made for the tucking in of the thread into the center of the skein when the latter is stripped from the fid, this feature is not essential and the thread could simply be cut by any suitable means after a skein is doffed from the mandrel onto the fid. It will also be apparent that although in all the embodiments described the mandrel rotates continuously to provide high productivity of skeins, the means for tucking the end of the thread into the center of the skein could be provided on machines where continuous winding of skeins was not featured.

Whilst the fid has been described on the context of either a stationary or rotatable rod, it will be understood that any means for supporting the skein whilst it is doffed from the mandrel and transferred to the cup 12 is contemplated within the term "fid."

It will further be appreciated that although the embodiments of the invention described have referred to the winding of skeins they could equally well have referred to other cross-wound packages.

We claim:

1. A cross-winding machine, comprising a winding mandrel, means for continuously rotating the mandrel whilst cross-wound packages are successively formed thereon, a package support extending in alignment with the mandrel to receive wound packages therefrom, package doffing means having a package doffing member and reciprocable means for moving said member, upon completion of winding on the mandrel of a first wound package, alongside the mandrel first from a retracted position remote from the package support to a position in which rotation of said first wound package at mandrel speed is maintained until a predetermined part of the winding of a second package has been effected on the mandrel and then to a position in which said first wound package is transferred to the package support, and, thread severing means operable to cut thread between the mandrel and the package support.

2. A machine as claimed in claim 1, wherein the package support is non-rotatably mounted and is adapted to engage within packages transferred thereto by the doffing means, the package support thereby effecting slowing down of the packages transferred thereto.

3. A machine as claimed in claim 2, wherein the package support is mounted for displacement thereof from the position in which it is aligned with the mandrel to a position in which a package can be removed therefrom in a direction reverse to that in which said package was doffed on to the package support.

4. A machine as claimed in claim 3, wherein an ejector member is provided and mounted for movement relatively to the package support in the displaced position of the latter, such relative movement causing removal of a package from the support in the direction reverse to that in which said package was doffed on to the package support.

5. A machine as claimed in claim 2, wherein thread retaining means are provided on the package support at the end thereof adjacent the mandrel, said thread retaining means being engaged by thread between the mandrel and the package support on transfer to the support of a wound package.

6. A machine as claimed in claim 5, wherein the thread retaining means includes the thread severing means.

7. A machine as claimed in claim 6, wherein the thread retaining means comprise a member mounted in the package support and reciprocable in an axial direction with respect to the support, the member being formed with a slot within which thread is engaged upon transfer to the support of a wound package, the edges of the slot cooperating with the edge of the package support so that on retracting of the member into the support a thread engaged in the slot of the member is first retained and then severed.

8. A machine as claimed in claim 1, wherein the package support engages within a package on transfer of the package from the mandrel and there are provided thread retaining means on the support at the end thereof adjacent the mandrel which, upon doffing of a package from the mandrel on to the package support, are engaged by the thread between the mandrel and the package support, and ejector means reciprocably movable relative to the package support to strip the package from the package support in a direction reverse to that in which it was transferred to the support from the mandrel whereby as the package is stripped from the support the end of the thread is brought into the center of the package and is released from the retaining means during movement of the ejector means to strip the package from the support and means for mounting the package support for movement to a position in which the package can be stripped therefrom by the ejector means.

9. A machine as claimed in claim 8, wherein the thread retaining means comprise a member mounted in the package support and reciprocable in an axial direction with respect to the support, the member being formed with a slot within which thread is engaged upon slowing down of the support relatively to the mandrel, the edges of the slot cooperating with the edge of the package support so that on retracting of the member into the support a thread engaged in the slot of the member is first retained and then severed.

10. A machine as claimed in claim 8, wherein the thread retaining means are in the form of a hook.

11. A machine as claimed in claim 1 including a second winding mandrel and a guiding drum adapted to supply yarn to each of said mandrels and wherein the doffing means comprise a plate which engages around each of said mandrels.

12. A machine as claimed in claim 1, wherein the package support engages within packages transferred thereto by the doffing means, means being provided for rotating the package support in synchronism with the mandrel whilst further means are provided for effecting slowing down of the rotation of the package support relatively to the mandrel.

13. A machine as claimed in claim 12, wherein the means for rotating the package support in synchronism with the mandrel comprise clutch means for connecting the package support to the mandrel whilst the further means for effecting slowing down of the package support comprise mounting means for displacing the package support between positions thereof respectively in driving engagement with and disengaged from the mandrel.

14. A machine as claimed in claim 13, wherein said means for effecting displacement of the package support between said positions thereof comprises a pivot, an arm rotatably carried on said pivot, and bearings on said arm for mounting said package support.

15. A machine as claimed in claim 14, further comprising a doffing member fixed relatively to the arm for stripping a package from the support in a direction reverse to that in which the package was doffed on to the support as the arm is rotated about its pivot from the engaged position of the package support with the mandrel.

16. A machine as claimed in claim 13, wherein thread retaining means are provided on the package support at the end thereof adjacent the mandrel, said thread retaining means being engaged by thread between the mandrel and the package support on slowing down of the support relatively to the mandrel.

17. A machine as claimed in claim 16, wherein the thread retaining means includes the thread severing means.

18. A machine as claimed in claim 16, wherein the thread retaining means comprise a member mounted in the package support and reciprocable in an axial direction with respect to the support, the member being formed with a slot within which thread is engaged upon slowing down of the support relatively to the mandrel, the edges of the slot cooperating with the edge of the package support for first retaining and then severing a thread engaged in the slot of the member on retracting of the member into the support.

19. A machine as claimed in claim 16, wherein the thread retaining means is in the form of a hook.

20. A machine as claimed in claim 12, wherein the means for rotating the package support includes bearings, a hub mounted in said bearings and having drive means connected thereto, the package support being carried in the hub so as to be axially reciprocable relatively to the hub and between positions respectively adjacent the mandrel and spaced from the mandrel sufficiently to allow a wound package to pass between the mandrel and the package support.

21. A machine as claimed in claim 20, further comprising a doffing member means which is fixed relatively to the hub for removing a package from the support in a direction reverse to that in which the package was doffed on to the support when the package support is moved relatively to the hub away from the mandrel.

22. A machine as claimed in claim 21, wherein thread retaining means are provided on the package support at the end thereof adjacent the mandrel, said thread retaining means being engaged by thread between the mandrel and the package support on slowing down of the support relatively to the mandrel.

23. A machine as claimed in claim 22, wherein the thread retaining means includes the thread severing means.

24. A machine as claimed in claim 22, wherein the thread retaining means comprise a member mounted in the package support and reciprocable in an axial direction with respect to the support, the member being formed with a slot within which thread is engaged upon slowing down of the support relatively to the mandrel, the edges of the slot cooperating with the edge of the package support for first retaining and then severing a thread engaged in the slot of the member on retracting of the member into the support.

25. A machine as claimed in claim 21, wherein the thread retaining means are in the form of a hook.

* * * * *